United States Patent [19]

Ishikawa

[11] Patent Number: 4,487,177

[45] Date of Patent: Dec. 11, 1984

[54] APPARATUS AND METHOD FOR STARTING A DIESEL ENGINE USING PLASMA IGNITION PLUGS

[75] Inventor: Yasuki Ishikawa, Yokosuka, Japan

[73] Assignee: Nissan Motor Company, Limited, Kanagawa, Japan

[21] Appl. No.: 461,125

[22] Filed: Jan. 26, 1983

[30] Foreign Application Priority Data

Mar. 23, 1982 [JP] Japan ..... 57-44707

[51] Int. Cl.[3] ..... F02B 9/08; F02P 23/00; F02P 1/00

[52] U.S. Cl. ..... 123/260; 123/179 BG; 123/653; 123/654; 123/655; 123/656; 123/143 B; 123/620; 123/298; 123/169 MG; 123/253

[58] Field of Search ..... 123/144, 143 B, 260, 123/253, 620, 169 MG, 145 A, 179 BG

[56] References Cited

U.S. PATENT DOCUMENTS 3,032,683 5/1962 Ruckelshaus ..... 123/654
4,041,922 8/1977 Abe ..... 123/143 B
4,059,079 11/1977 Kasima ..... 123/260
4,398,526 8/1983 Hamai ..... 123/143 B

FOREIGN PATENT DOCUMENTS 57-146059 9/1982 Japan ..... 123/620

*Primary Examiner*—Ronald B. Cox
*Attorney, Agent, or Firm*—Lowe, King, Price & Becker

[57] ABSTRACT

A diesel engine is started by plural ignition plugs, each installed in a swirl chamber of a corresponding cylinder. Each ignition plug includes (a) an elongated center electrode, (b) a fuel-absorbent electrical insulator that encapsulates the center electrode so as to allow only one end of the center electrode to protrude, and (c) a plurality of elongated grounding electrodes arranged symmetrically around said insulating member to define a discharge path in conjunction with the protruding end of the center electrode. The discharge path includes part of the surface of the insulating member and an air gap between free ends of the grounding electrodes and opposing surfaces of the insulating member.

16 Claims, 9 Drawing Figures

APPARATUS AND METHOD FOR STARTING A DIESEL ENGINE USING PLASMA IGNITION PLUGS

BACKGROUND OF THE INVENTION

1. Field of the Invention

The present invention relates to an apparatus for starting a diesel engine actuated when an engine starter motor is rotated, which apparatus comprises an ignition plug installed within a subcombustion chamber, e.g., a swirl chamber of each engine cylinder, instead of an ordinary glow plug so that the engine can start immediately without a preheating process required when the glow plug is used.

2. Description of the Prior Art

Glow plug engine start systems have conventionally been used to start diesel-type internal combustion engines.

A fuel injection valve is installed in a swirl chamber located above a main combustion chamber and interlinked with the main combustion chamber via an injection hole. The glow plug a threaded portion for mounting the plug in the swirl chamber; a heating portion of the plug is exposed in the swirl chamber to aerosol fuel injected from the injection valve. DC voltage is applied to the glow plug from a battery via an ignition key switch. In more detail, a positive pole of the battery is connected to the ignition switch having "START", "ON", "PREHEAT", and "STOP" terminals. The "START" terminal and "PREHEAT" terminal are connected to a pilot lamp and to the glow plugs, one of which is located in each cylinder.

In a conventional engine start system as described above, to start the diesel engine DC current flows from the battery to each glow plug while the ignition switch is set to the "PREHEAT" terminal position. Each glow plug glows with sufficient heat after application of the DC current for several seconds through several tens of seconds. After warm up of the glow plugs, the ignition switch is set to the "START" terminal position to rotate a starter motor to crank the engine while the DC voltage continues to be supplied to the glow plugs. A certain amount of fuel is injected by the fuel injection valve into the swirl chamber which receives and swirls the high-temperature compressed air to start fuel combustion.

However, a problem is that it takes a long time for the engine to start since several seconds through several tens of seconds are required to heat the glow plugs before the engine can be cranked. In addition, a large current of approximately 10 through 15 amperes must be sent through the glow plugs for such a long period of time. Therefore, the capacity of the battery is greatly reduced. This is particularly deleterious when the engine is started under low-temperature ambient conditions.

SUMMARY OF THE INVENTION

With the above-described problem in mind, it is an object of the present invention to provide a new start system for a diesel engine which eliminates the preheating process described above and the wasteful power drain on the battery.

This object is achieved by providing an ignition plug within the swirl chamber in place of the conventional glow plug. The ignition plug comprises a center electrode, a ceramic insulating member, and a plurality of ground electrodes, a discharge portion between the center electrode and ground electrodes encloses an air gap portion and part of the surface of the insulating member. A discharge at the discharge portion ignites and combusts a portion of the fuel adsorbed by the surface of the insulating member; the flame generated by a creeping discharge over part of the surface of the insulating member ignites and combusts the aerosol fuel.

BRIEF DESCRIPTION OF THE DRAWINGS

A more complete understanding of the present invention may be obtained from the following detailed description taken in conjunction with the drawings in which like reference numerals designate corresponding elements and in which.

DETAILED DESCRIPTION OF THE PREFERRED EMBODIMENTS

Reference will hereinafter be made to the drawings in order to facilitate understanding of the present invention.

Figure 1:
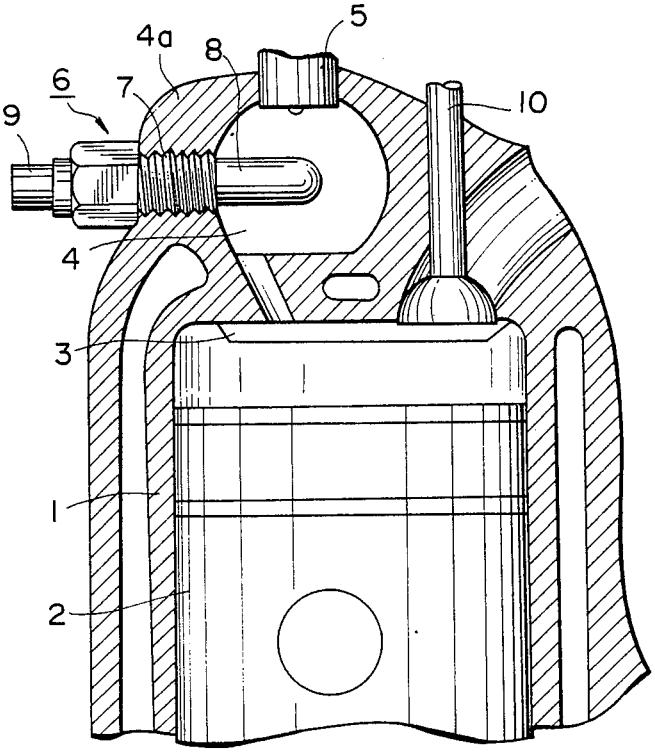
FIG.1 PRIOR ART
FIG. 1 is a cut-away view of one cylinder of a diesel engine wherein a prior art glow plug for starting a diesel engine is incorporated.

FIG. 1, shows a cross sectional view of a typical prior art diesel engine structure in which a glow plug is incorporated, includes an engine cylinder 1, a piston 2, and denotes a main combustion chamber 3 defined in part by the top end of the piston 2. In the diesel engine shown in FIG. 1, a swirl chamber 4 with an essentially spherical shape is located above the main combustion chamber 3. Intake air is conducted into the swirl chamber 4 from an injection hole such that swirl occurs. A fuel injection valve 5 is attached to the cylinder 1 such that an injection nozzle of the injection valve 5 faces into the swirl chamber 4. A glow plug 6 is also attached to a wall 4*a* of the swirl chamber 4 by means of a screw portion 7 so that a heating portion 8 of the glow plug 6 protrudes into the swirl chamber 4. Therefore, the heating portion 8 of the glow plug 6 is exposed to aerosol fuel from the fuel injection valve 5. Exhaust gases are vented from chamber 3 via exhaust valve 10.

Figure 2:
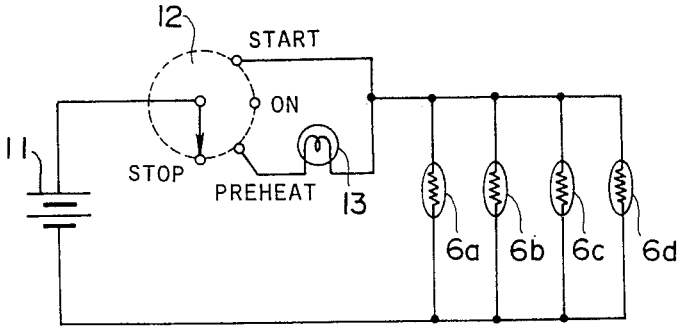
FIG.2 PRIOR ART
FIG. 2 is a prior art electric circuit diagram for powering a plurality of glow plugs of the type shown in FIG. 1.

FIG. 2 is a circuit diagram an electric circuit for supplying DC current to each of the glow plugs 6a through 6d, wherein each glow plug is mounted in the corresponding engine cylinder as shown in FIG. 1.

In FIG. 2, an ignition key switch 12 is connected between the battery 11 and the four glow plugs 6a through 6d (in the case of a four-cylinder engine). The ignition switch 12 has four set positions; i.e., START, ON, PREHEAT, and STOP. The "START" terminal is connected to an engine starter motor (not shown). One end of each glow plug 6a through 6d is connected to the "START" terminal of the ignition switch 12 directly and to the "PREHEAT" terminal via a pilot lamp 13.

When the ignition switch 12 is set to the "PREHEAT" terminal position, DC current flows from the battery 11 to each of the four glow plugs 6a through 6d via the ignition switch and pilot lamp 13 so that each of glow plugs 6a through 6d starts to glow. After warming up each glow plug 6a through 6d for several seconds through several tens of seconds, the ignition key switch 12 is set to the "START" terminal position so as to rotate a starter motor (not shown) while the glow plugs 6a through 6d continue to receive DC current from the battery 11. At this time, the engine cranks. Aerosol fuel is then intermixed with compressed air at a high temperature in the combustion chamber 4 so that combustion of fuel commences.

Figure 3:
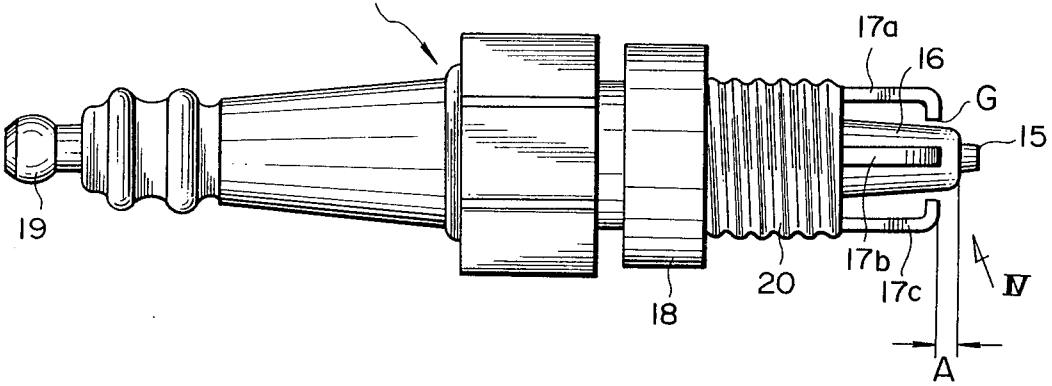
FIG. 3 is a side view of an ignition plug for use in a preferred embodiment of the present invention.
Figure 4:
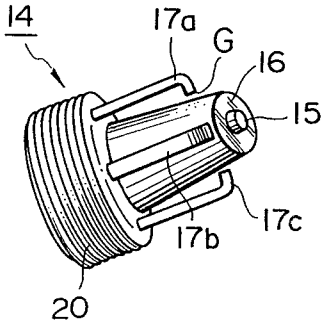
FIG. 4 is a perspective view of the tip of an ignition plug as viewed from IV of FIG. 3.

FIGS. 3 and 4 are drawings of an ignition plug of one preferred embodiment according to the present invention. The ignition plug 14 replaces glow plug 6 in each engine cylinder, such as that shown in FIG. 1.

The ignition plug 14 comprises a center electrode 15, a dielectric, electrically insulating member 16 encapsulating the center electrode 15 in a substantially cylindrical form or in the form of a slightly tapered circular truncated cone such that only the tip of the center electrode 15 projects from the insulating member 16, and a plurality of ground electrodes 17a through 17d arranged around the insulating member 16. (There are four ground electrodes in the plugs of FIGS. 3 and 4; however one ground electrode 17d cannot be seen.)

The center electrode 15 is connected to a high-voltage supply terminal 19 and electrically insulated from a frame 18. On the other hand, the grounding electrodes 17a through 17d are electrically and mechanically connected to a fixing means 20 of the ignition plug 14, such as a threaded portion. The fixing means 20 serves to attach the ignition coil 14 to the wall 4a of the swirl chamber 4, as shown in FIG. 1. The engine body acts as ground with respect to the ground electrodes. A discharge path is defined by the tip of the center electrode 15 projecting from the insulating member 16 and the opposing end surface of the grounding electrodes 17a through 17d. A spark discharge occurs along the discharge path when a voltage exceeding the dielectric breakdown voltage is supplied to the high voltage supply terminal 19. The discharge path includes the surfaces of the insulating member 16 which lie between the free ends of the grounding electrodes and the tip of the center electrode 15, and the air gap portions G defined by the free end of each grounding electrode and the opposing surface of the insulating member 16. Therefore, the relative positions of the exposed end of the central electrode 15, insulating member 16, and each ground electrode 17a through 17d needs to be selected properly. In more detail, the axial offset A between the top edge of the insulating member 16 and the free ends of the grounding electrodes 17a through 17d is preferably 1 millimeter or more.

It should be noted that a material which can adsorb fuel onto its surface is required for the insulating member, preferably a porous ceramic such as an alumina ceramic.

On the other hand, it is preferable that a metal having a high melting point such as tungsten or an alloy thereof be used for the electrodes to increase durability.

Figure 6:
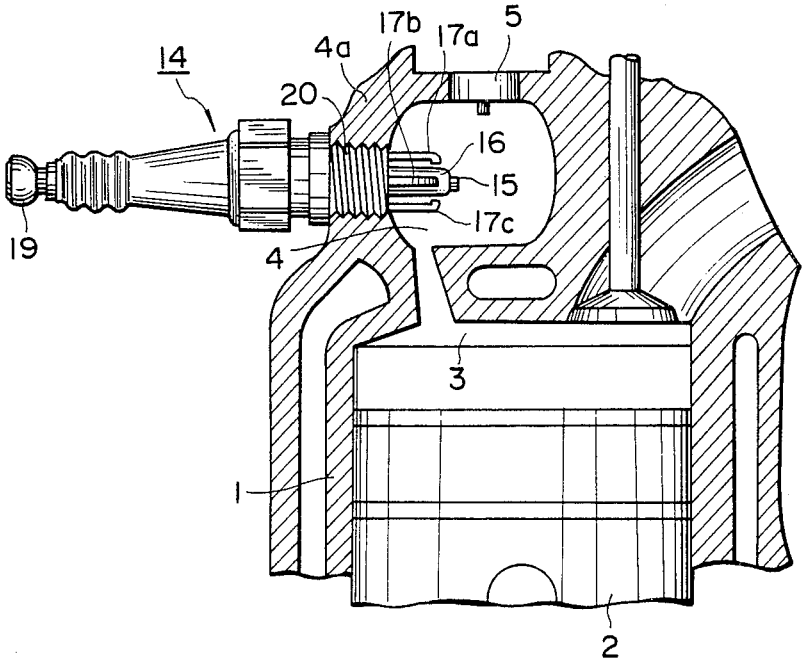
FIG. 6 is a cut-away view of one cylinder of a diesel engine wherein the ignition plug shown in FIG. 3 is incorporated.

FIG. 6 is a cross section of engine cylinder 1 in combination with installed ignition plug 14. The ignition plug 14 is secured to the wall 4a of the swirl chamber via the fixing means 20. In this case, the ignition plug 14 is mounted in the swirl chamber 4 so that the discharge portion formed between the end surface of the insulating member 16 and air gap portion G substantially coincides with the center of the aerosol fuel injection pattern from the fuel injection valve 5.

Figure 7A:
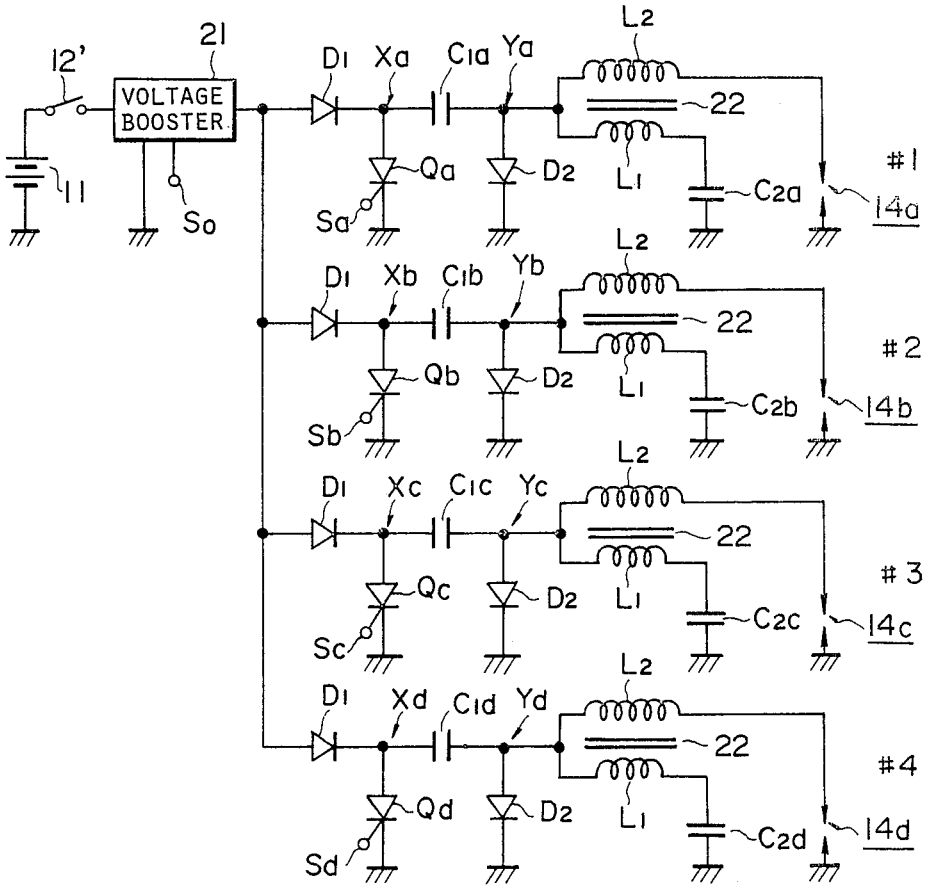
FIG. 7(A) is an electrical circuit diagram of a diesel engine starting apparatus for applying ignition energy to a plurality of ignition plugs, each typically as shown in FIG. 3 and FIG. 6.

FIG. 7(A) is a circuit diagram of a typical ignition energy supply circuit for supplying ignition energy to the ignition plugs 14a through 14d of FIGS. 3 and 4 (in the case of a four-cylinder diesel engine, there are four ignition plugs, each located within one of the engine cylinders).

In FIG. 7(A), a voltage booster, 21 includes input terminal So responsive to a pulse signal for controlling the boosting operation of the booster 21. The output of booster 21 is coupled to four parallel ignition energy supply circuits, one for each of plugs 14a–14d. Each of the ignition supply circuits includes diodes $D_1$ and $D_2$ between which are connected shunt thyristors Q and series capacitors $C_1$. The components associated with plugs 14a–14d respectively bear reference numerals a-d. Pulse signals at terminals Sa–Sd control the activation of the respective thyristors Qa through Qd. Each ignition energy supply circuit includes boosting transformer 22 having primary winding $L_1$ and secondary winding $L_2$. Capacitors $C_2$ are connected between a terminal of each of windings $L_1$ and ground.

The operation of the ignition system is described below with reference to FIG. 7(A).

To start the diesel engine, the starter motor is energized by activating the ingition energy supply circuit shown in FIG. 7(A). As the diesel engine rotates, the fuel pressurized and supplied by a fuel pump (not shown) is injected as an aerosol by the fuel injection valve 5 into the swirl chamber 4 at a predetermined time. Since the temperature within the swirl chamber 4 and main combustion chamber 3 is low at the time of engine start-up (particularly when the ambient temperature is relatively low) and the fuel injected by the fuel injection valve 5 can not be completely atomized during engine start-up, the injected fuel does not ignite spontaneously. The injected fuel is scattered around the swirl chamber 4 and main combustion chamber 3 and adsorbed by the surface of the insulating member 16 of each of the ignition plugs 14a through 14d.

In FIG. 7(A), the low DC voltage (12 volts) of the battery 11 is boosted into a high voltage (+1500 volts) by means of the voltage booster 21. The high voltage charges each of the first capacitors $C_{1a}$ through $C_{1d}$ via the corresponding first diode $D_1$. At this time, the other terminal of each of the first capacitors $C_{1a}$ through $C_{1d}$, connected to the corresponding terminals Ya through Yd, shown in FIG. 7(A), is grounded.

When each pulse signal at terminal Sa through Sd is sequentially applied to the gate terminal of a corresponding thyristor Qa through Qd at a predetermined ignition timing in synchronization with the timing of fuel injection from the corresponding fuel injection valve 5, the thyristor Qa through Qd receiving the corresponding pulse signal Sa through Sd turns on and the potential at a corresponding terminal Xa through Xd is abruptly grounded. Therefore, the potential at the corresponding terminal Ya through Yd changes from zero volts to minus 1500 volts.

Voltage is thus applied across the boosting transformer 22 because of the potential change from zero to minus 1500 volts at the appropriate one of terminals Ya through Yd. A primary circuit comprising the primary winding $L_1$ of each transformer 22 and the corresponding second capacitor $C_{2a}$ through $C_{2d}$ generates a damped oscillation, causing a secondary winding of the corresponding transformer 22 to generates an abrupt high surge voltage with a peak value of about minus 20 kilovolts; the high surge voltage amplitude is directly proportional to the winding ratio between the primary and secondary windings $L_1$ and $L_2$. This high surge voltage with a peak value of about minus 20 kilovolts is applied to the corresponding ignition plug 14*a* through 14*d*, so that a spark discharge is generated along the discharge path between the center electrode 16 and grounding electrodes 17*a* through 17*d*. Consequently, the fuel adsorbed by the surface of the insulating member 16 is ignited. Since an insulation resistance between the electrodes is reduced substantially to zero due to the discharge described hereinabove, the high energy (having a value of approximately 0.5 through 2 Joules) stored in the corresponding capacitor is transferred into the corresponding ignition plug 14*a* through 14*d* via the secondary winding $L_2$ of the boosting transformer 22 in a very short period of time (about 0.1 milliseconds). Therefore, a creepage discharge occurs along the end surface of the insulating member 16 in the form of a high energy flame-like plasma jet. The creepage discharge causes the injected fuel to ignite and combust and the combustion force causes the engine to start.

The above-described operation is carried out for each engine cylinder of the diesel engine as each of the pulse signals Sa through Sd is coupled to the corresponding thyristors Sa through Sd in accordance with the ignition timing of each engine cylinder. In addition, the boosting operation of voltage booster 21 (e.g., a DC-DC converter) is cut off while the pulse signal is coupled to terminal So so that the thyristors Qa through Qd consequently turn off after the discharge of electrical charge from the corresponding capacitors $C_{1a}$ through $C_{1d}$ is completed.

Figure 7B:
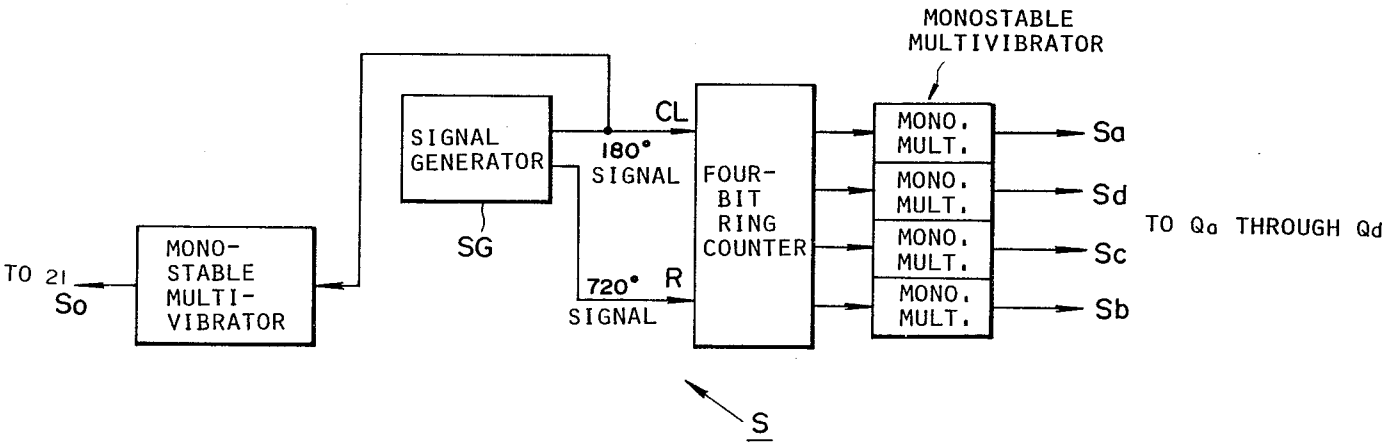
FIG. 7(B) is a circuit block diagram of a circuit which generates pulse signals to be sent into appropriate circuit elements shown in FIG. 7(A)

The pulse signal at each of terminals So and Sa through Sd is generated by an ignition signal generator S (FIG. 7B) at the predetermined timing. The ignition signal generator S of FIG. 7(B) includes signal generator SG comprising a crank angle sensor which derives 180° and 720° signals whenever the engine respectively rotates through 180° and 720°. The 180° signal and the 720° signals may also be derived from the fuel supply timing of the fuel pump.

Figure 5:
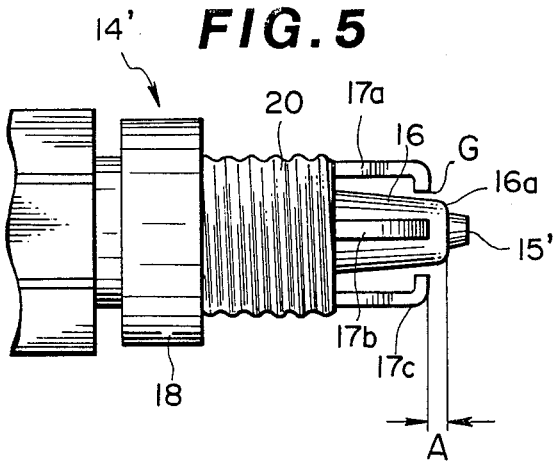
FIG. 5 is a side view of the tip of an ignition plug for use in another preferred embodiment of the present invention.

FIG. 5, a side view of another preferred embodiment of the ignition plug according to the present invention, includes center electrode 15' having an exposed tip with a peaked shape, i.e., a slightly tapered truncated cone shape. Since the center electrode 15' is constructed in such a form, the ignition plug 14' can wear out only the part of the exposed tip of the center electrode 15' which is in the vicinity of the insulating material 16. Thereby the circumferential edge of the end surface of the center electrode 15' does not erode.

Furthermore, in conventional four cylinder diesel engine start system using glow plugs, there is a large difference between exhaust temperatures from the first and fourth engine cylinders which are located at the extreme ends of the crankshaft and the second and third engine cylinders which are located between the first and fourth cylinders along the crankshaft. This has been determined by measuring the characteristics of exhaust temperature with respect to elapsed time during engine start operations. Consequently, there is an imbalance in cylinder temperature and in combustion state among the engine cylinders.

To cope with such a situation, the capacitance of the first capacitors $C_{1a}$ and $C_{1d}$ allocated to the first and fourth cylinders #1 and #4 can be 1 microfarad and that allocated to the second and third cylinders #2 and #3 can be 0.5 microfarad by way of example. In this way, a difference in capacitance between the first capacitors for the engine cylinders externally and internally located is provided so that the electrical charge within the first capacitors $C_{1a}$ and $C_{1d}$ and that within the first capacitors $C_{1b}$ and $C_{1c}$, i.e., the amount of energy to be discharged through each ignition plug 14*a* through 14*d* is adjusted appropriately. Consequently, the temperature of each engine cylinder and the combustion state thereof can be balanced and a favorable combustion of fuel can be achieved for all of the engine cylinders.

Figure 8:
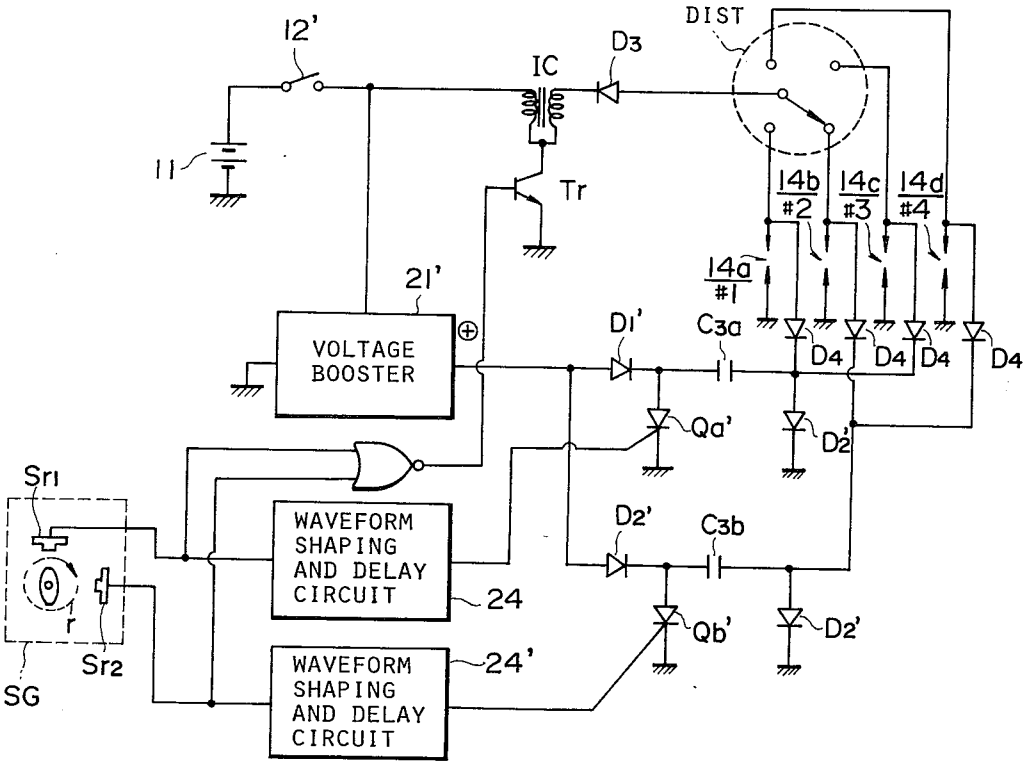
FIG. 8 is another electrical circuit diagram of a diesel engine start apparatus for applying ignition energy to the plurality of ignition plugs, each typically as shown in FIG. 3 and FIG. 6.

FIG. 8 is a partial circuit and partial block diagram of another ignition energy supply circuit using a distributor DIST and ignition coil IC, wherein the spark discharge occurs sequentially at each of the ignition plugs 14*a* through 14*d* according to the predetermined ignition order due to a high surge voltage from the ignition coil IC when a transistor Tr is turned off. The subsequent creepage discharge occurs when the energy within each third capacitor $C_{3a}$ and $C_{3b}$ is discharged into the corresponding pair of ignition plugs 14*a* and 14*d* or 14*b* and 14*c*. Since the two ignition plugs 14*a* and 14*d* or 14*b* and 14*c* are combined in such a way that one of the corresponding engine cylinders is in the ignition stroke while the other engine cylinder is in the exhaust stroke, the additional ignition plug only generates a superfluous creepage discharge. The ignition energy supply circuit shown in FIG. 8 is disclosed in No. JP-A-57-186065. Thus the number of the third capacitors $C_{3a}$ and $C_{3d}$ can be reduced to half that of the ignition plugs 14*a* through 14*d*.

Similarly in this case, the capacitance value of third capacitor $C_{3a}$, associated with the first and fourth cylinders, i.e., cylinders #1 and #4, can be reduced to half that of the other third capacitor $C_{3b}$. Two sensors $Sr_1$ and $Sr_2$ are located about a rotor r which rotates at half the speed of the engine crankshaft; sensors $Sr_1$ and $Sr_2$ are at a right angle to each other so that whenever the rotor r rotates 90° one of the sensor supplies a surge signal to a corresponding waveform shaping and delay circuit 24 or 24'.

As described hereinabove, according to the present invention each glow plug for starting a diesel engine is replaced by an ignition plug having a center electrode, an electrical insulating member made of a material having fuel adsorbing characteristics, and a plurality of grounding electrodes. A high voltage is applied to the ignition plug so that a discharge generated between the electrodes causes the fuel adsorbed by the insulating member to ignite and combust, so a flame-like plasma of high energy is sent through the ignition plug to generates a creepage discharge along the surface of the insulating member located between both electrodes so that the injected fuel is ignited and combusted. Consequently. complete combustion of aerosol fuel injected into the swirl chamber can be achieved, particularly in the case of the engine start-up at low ambient temperatures, so the engine can start immediately without a preheating process. Furthermore, the electrical power of the battery is conserved.

It will be clearly understood by those skilled in the art that modifications may be made in the preferred embodiments described herein without departing from the spirit and scope of the present invention, which is defined by the appended claims.

What is claimed is:

1. Apparatus for initiating operation of a diesel engine having multiple diesel cylinders at least one of which has an exhaust temperature characteristic that tends to differ during starting from the exhaust temperature characteristics of another of the cylinders, comprising means for supplying a fuel air mixture to each cylinder, a plasma ignition plug for each cylinder to initiate combustion of the supplied mixture in the associated cylinder, and means for applying discharge energy to the plugs during starting so that different amounts of energy are applied to the plugs tending to have the different exhaust temperature characteristics so that the exhaust temperature and combustion states of the cylinders are approximately the same during starting to overcome the tendency of the differing exhaust temperature characteristics.

2. A method of initiating operation of a diesel engine having multiple diesel cylinders at least one of which has an exhaust temperature characteristic that tends to differ during starting from the exhaust temperature characteristics of another of the cylinders, a plasma ignition plug for each cylinder initiating combustion of the supplied mixture in the associated cylinder, the method comprising supplying a fuel air mixture to each cylinder, applying discharge energy to the plugs during starting so that different amounts of energy are applied to the plugs tending to have the different exhaust temperature characteristics so that the exhaust temperatures and combustion states of the cylinders are approximately the same during starting to overcome the tendency of the differing exhaust temperature characteristics.

3. An apparatus for starting a diesel engine in cooperation with an engine starter motor, which comprises:

(a) a plurality of ignition plugs each installed in a chamber of a corresponding engine cylinder of the engine, each ignition plug including a truncated cone shaped electric fuel absorbing insulator, an elongated center electrode projecting from one end of said insulator, and a plurality of grounded electrodes equally spaced apart from each other and arranged symmetrically around said insulator, each grounded electrode having a tip bent toward said insulator so as to provide a creepage discharge path on a surface of said insulator and said elongated center electrode, the insulator and grounded electrodes of each ignition plug being disposed in a fuel combustion chamber of each engine cylinder so as to receive sprayed fuel from a fuel injection valve; and (b) an ignition energy supply circuit connected to said ignition plugs, said circuit generating and supplying a high surge voltage across each electrode of said ignition plugs according to a predetermined ignition order whenever each electrode receives sprayed fuel from the corresponding injection valve so that a spark discharge occurs along the creepage discharge path on the surface of said insulator so as to ignite fuel absorbed on the surface of said insulator, said circuit thereafter supplying a high ignition energy across one of said ignition plugs where the spark discharge has occurred to generate a plasma flame along the creepage discharge path so as to ignite sprayed fuel within the combustion chamber.

4. An apparatus for starting a diesel engine comprising:

(a) a plurality of ignition plugs each installed in a chamber of a corresponding engine cylinder together with a fuel injection valve such that a discharge path of each ignition plug is located within the injection path of fuel injected into the chamber by said fuel injection valve, each ignition plug including (a) an elongated center electrode, (b) an insulating member made of a material with fuel-absorbent characteristics and encapsulating said center electrode so that only one end of said center electrode projects therefrom, and (c) a plurality of elongated grounding electrodes arranged symmetrically around said insulating member and defining the discharge path in conjunction with the end of said center electrode projecting from said insulating member, said discharge path being arranged so as to include part of the surface of said insulating member and an air gap between an end of each grounding electrode and the opposing surface of said insulating member; and (b) an ignition energy supply circuit connected to said ignition plugs for generating and supplying a high surge voltage to each of said ignition plugs according to a predetermined ignition order in synchronization with fuel injection timing of the fuel injection valve so that a spark discharge occurs along the discharge path thereof and for supplying a high ignition energy through one of said ignition plugs having a spark discharge to generate a creepage discharge along the peripheral surface of said insulating member between said electrodes, said ignition energy supply circuit being actuated in conjunction with an engine starter motor, the high ignition energy generated by said ignition energy supply circuit differing depending on which of the ignition plugs is being energized to adjust the amount of ignition energy supplied to the corresponding engine cylinder so as to balance the combustion state and the temperature among the engine cylinders.

5. The apparatus of claim 1 wherein the means for applying differing amounts of energy includes storage capacitor means for storing energy to be applied to the plugs during starting, the storage capacitor means for cylinders having like first exhaust temperature characteristics having like values different from the values of the storage capacitor means for cylinders having like second exhaust temperature characteristics, the first and second exhaust temperature characteristics differing from each other.

6. The apparatus of claim 5 wherein the means for applying includes means for applying like voltages to all of said storage capacitor means.

7. The apparatus of claim 6 wherein the capacitor means includes electrodes series connected between the means for applying like voltages and the plugs.

8. The apparatus of claim 7 wherein the capacitor means includes a series capacitor connected to simultaneously supply energy to a plurality of the plugs.

9. The apparatus of claim 7 wherein the capacitor means includes a series capacitor, one for each plug, connected to supply energy only to the one plug connected thereto.

10. The apparatus as set forth in claim 4, wherein the ignition energy supplied to the engine cylinders which are located at the extreme ends of an engine crankshaft is larger than that supplied to the other engine cylinders which are located along the central portion of the engine crankshaft.

11. The apparatus as set forth in claim 3, wherein the projecting end of said center electrode is of a cylindrical shape.

12. The apparatus as set forth in claim 3, wherein said insulating member is made of alumina ceramic.

13. The apparatus as set forth in claim 3, wherein the projecting end of said center electrode is of a truncated cone shape.

14. The apparatus as set forth in claim 3, wherein said the grounding electrodes and the center electrode of each of said ignition plug are made of Tungsten or an alloy thereof.

15. The apparatus as set forth in claim 3, wherein the high ignition energy generated by said ignition energy supply circuit differs depending on which of the ignition plugs is being energized in order to adjust the amount of ignition energy to be supplied to the corresponding engine cylinder so as to balance the combustion state and the temperature among the engine cylinders.

16. The apparatus as set forth in claim 3, wherein the ignition energy supplied to the engine cylinders which are located at the extreme ends of an engine crankshaft is larger than that supplied to the other engine cylinders which are located along the central portion of the engine crankshaft.

* * * * *